US009630399B2

(12) United States Patent
Ishida et al.

(10) Patent No.: US 9,630,399 B2
(45) Date of Patent: Apr. 25, 2017

(54) METHOD FOR CLEANING LIQUID EJECTION HEAD

(71) Applicant: CANON KABUSHIKI KAISHA, Tokyo (JP)

(72) Inventors: Yuzuru Ishida, Yokohama (JP); Yoshinori Misumi, Tokyo (JP); Maki Kato, Fuchu (JP); Norihiro Yoshinari, Kawasaki (JP); Akio Goto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/692,533

(22) Filed: Apr. 21, 2015

(65) Prior Publication Data

US 2015/0306877 A1 Oct. 29, 2015

(30) Foreign Application Priority Data

Apr. 23, 2014 (JP) ..... 2014-089515

(51) Int. Cl.
*B41J 2/165* (2006.01)
*B41J 2/045* (2006.01)
*B41J 2/14* (2006.01)

(52) U.S. Cl.
CPC ..... *B41J 2/04508* (2013.01); *B41J 2/0458* (2013.01); *B41J 2/04513* (2013.01); *B41J 2/04588* (2013.01); *B41J 2/04596* (2013.01); *B41J 2/1412* (2013.01); *B41J 2/14129* (2013.01)

(58) Field of Classification Search
CPC B41J 2/14129; B41J 2/04508; B41J 2/04513; B41J 2/0458; B41J 2/04588; B41J 2/04596; B41J 2/1412; B41J 2/16517; B41J 2/165
USPC ..... 347/26, 44, 61, 65
See application file for complete search history.

(56) References Cited

U.S. PATENT DOCUMENTS 7,950,769 B2 * 5/2011 Sakai ..... B41J 2/14129 347/22
2007/0146428 A1 6/2007 Sakai

FOREIGN PATENT DOCUMENTS

CN 101612830 A 12/2009
CN 101734014 A 6/2010
CN 103298618 A 9/2013
(Continued)

*Primary Examiner* — Jannelle M Lebron
(74) *Attorney, Agent, or Firm* — Canon USA, Inc. IP Division

(57) ABSTRACT

A method for cleaning a liquid ejection head, including a flow path forming member forming a liquid flow path, a heat generating resistive element, and a coating layer covering the heat generating resistive element and in contact with the liquid, in which the heat generating resistive element is made to generate heat and the liquid is made to be ejected from ejection ports, the method including: applying a voltage to the coating layer to produce an electrochemical reaction between the coating layer and the liquid, and causing the coating layer to be eluted into the liquid, thereby removing kogation deposited on the coating layer; and causing the heat generating resistive element to generate heat and causing the liquid to be ejected from the ejection ports while a voltage is applied to the coating layer continuously or intermittently, thereby eliminating air bubbles generated due to the electrochemical reaction.

14 Claims, 6 Drawing Sheets

(56) References Cited

FOREIGN PATENT DOCUMENTS

JP 2008-105364 A 5/2008

* cited by examiner

METHOD FOR CLEANING LIQUID EJECTION HEAD

BACKGROUND

Field of the Invention

The present disclosure relates to a method for cleaning a liquid ejecting head.

Description of the Related Art

A liquid ejection head that ejects a liquid using a heat generating resistive element is used in a liquid ejecting apparatus, such as an inkjet printer. This liquid ejection head is provided with a flow path forming member that forms a flow path of a liquid, such as ink, and a heat generating resistive element. The heat generating resistive element is formed by, for example, an electrothermal converting element. When the heat generating resistive element is made to generate heat, a liquid is heated suddenly and is made to foam in a liquid contact area (i.e., at a thermal action portion) located above the heat generating resistive element. The foaming causes pressure with which the liquid is ejected from an ejection port. An image is recorded on a surface of a recording medium, such as paper, with the liquid. A configuration in which the heat generating resistive element is covered with an insulating layer to insulate the heat generating resistive element from the liquid is proposed. The heat generating resistive element receives the following complex actions: physical actions including impact due to cavitation caused by foaming and deaeration of the liquid, and chemical actions caused by the liquid. Thus, a configuration in which the heat generating resistive element is covered with a protective layer for protection is proposed.

In a liquid ejection head, the following phenomenon may occur: an additive, such as a coloring material included in a liquid, is decomposed when heated at a high temperature; the additive changes to a highly insoluble substance; and the additive is physically adsorbed into a layer that touches the liquid, such as an insulating layer and a protective layer. The physically adsorbed object is called "kogation." When kogation adheres to the protective layer, uneven heat conduction from a thermal action portion to the liquid may occur, foaming may become unstable, and ejection characteristics of the liquid may be affected.

To address this problem, Japanese Patent Laid-Open No. 2008-105364 discloses a configuration in which an electrically connectable upper protective layer is disposed in an area including a thermal action portion to form an electrode that causes electrochemical reaction with a liquid. There is a cleaning method in which kogation on the thermal action portion is removed by causing an upper protective layer to be eluted by an electrochemical reaction. In this method using the electrochemical reaction with the liquid, air bubbles are generated when the liquid is decomposed while the upper protective layer is eluted. Since the air bubbles stay on the upper protective layer, there is a problem that the electrochemical reaction between the upper protective layer and the liquid is inhibited. To address this problem, in Japanese Patent Laid-Open No. 2008-105364, cleaning is performed while pushing out the generated air bubbles from a foaming chamber by sucking the liquid or pressurizing from the side of a liquid supply port so that inhibition of the electrochemical reaction is prevented.

SUMMARY OF THE INVENTION

Disclosed herein is a method for cleaning a liquid ejection head, which includes a flow path forming member configured to form a liquid flow path, a heat generating resistive element, and a coating layer configured to cover the heat generating resistive element and configured to be in contact with the liquid, in which the heat generating resistive element is made to generate heat and the liquid is made to be ejected from ejection ports, the method including: applying a voltage to the coating layer to produce an electrochemical reaction between the coating layer and the liquid, and causing the coating layer to be eluted into the liquid, thereby removing kogation deposited on the coating layer; and causing the heat generating resistive element to generate heat and causing the liquid to be ejected from the ejection ports while a voltage is applied to the coating layer continuously or intermittently, thereby eliminating air bubbles generated due to the electrochemical reaction.

Further features of the present invention will become apparent from the following description of exemplary embodiments with reference to the attached drawings.

DESCRIPTION OF THE EMBODIMENTS

According to the present inventors' study, in the method described in Japanese Patent Laid-Open No. 2008-105364, the liquid ejection head is cleaned with a cap being attached because the head is cleaned while sucking and pressurizing the liquid. The cap is used for collecting a liquid. Therefore, if this cleaning method is applied to an elongated head that performs recovery using a tubular liquid suction cap, a complicated sequence of cleaning, a driving circuit, and the like for removing kogation cooperating with the liquid suction cap are required. Further, since removal of kogation takes from several tens of seconds to several minutes per each ejection port, time required for removing kogation of all the ejection ports in the elongated head becomes very long. Since the liquid is sucked for a long time, a great amount of liquid is required.

The present disclosure provides a method for cleaning a liquid ejection head capable of easily removing kogation.

Hereinafter, embodiments of the present disclosure are described with reference to the drawings.

Figure 1:
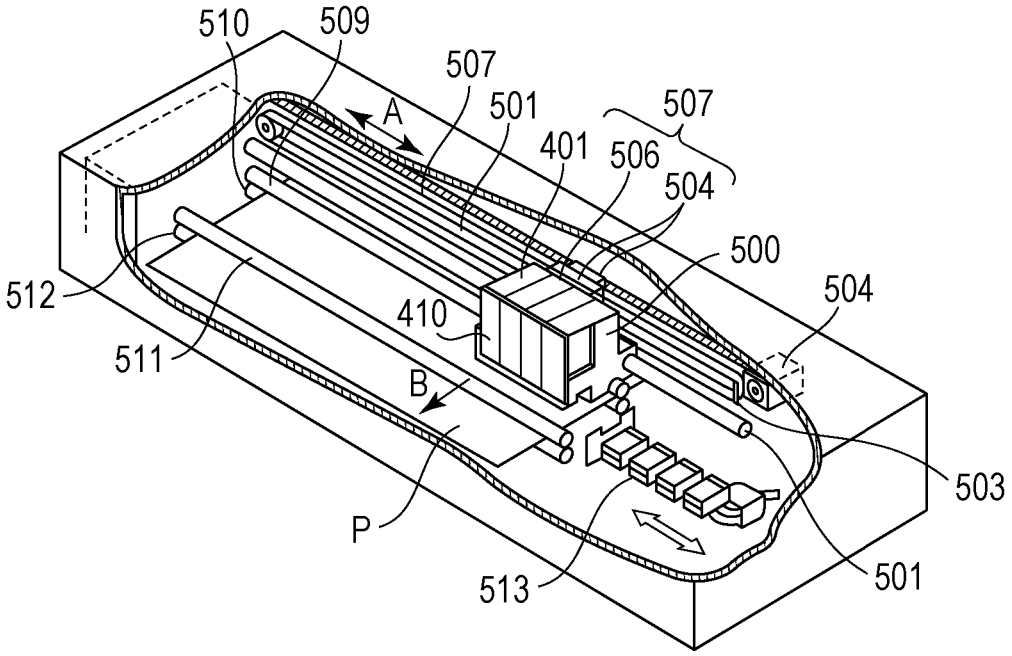
FIG. 1 is a perspective view of an inkjet recording apparatus.

FIG. 1 is a perspective view of an inkjet recording apparatus as an example of a liquid ejecting apparatus. A carriage 500 is supported by a guide 502. A liquid ejection head 410 is attached to the carriage 500 to perform printing. The guide 502 is attached to a chassis, and supports the carriage 500 to reciprocate in a direction orthogonal to a conveyance direction of a recording medium. The guide 502 is formed integrally with the chassis and holds a rear end of the carriage 500 to keep a gap between the liquid ejection head 410 and the recording medium. The carriage 500 is driven via a timing belt 501 by a carriage motor 504 attached to the chassis. The timing belt 501 is stretched and supported by an idle pulley 503.

When an image is formed on the recording medium, such as paper, in the configuration described above, regarding an up-down direction of the recording medium, a pair of rollers consisting of a conveyance roller 511 and a pinch roller convey and position the recording medium. Regarding a left-right direction of the recording medium, the carriage 500 is moved in a direction vertical to the conveyance direction by the carriage motor 504, and the liquid ejection head 410 is disposed at a target image formation position. In this manner, the liquid is ejected at the recording medium while the liquid ejection head 410 is moved relative to the recording medium.

Figure 2:
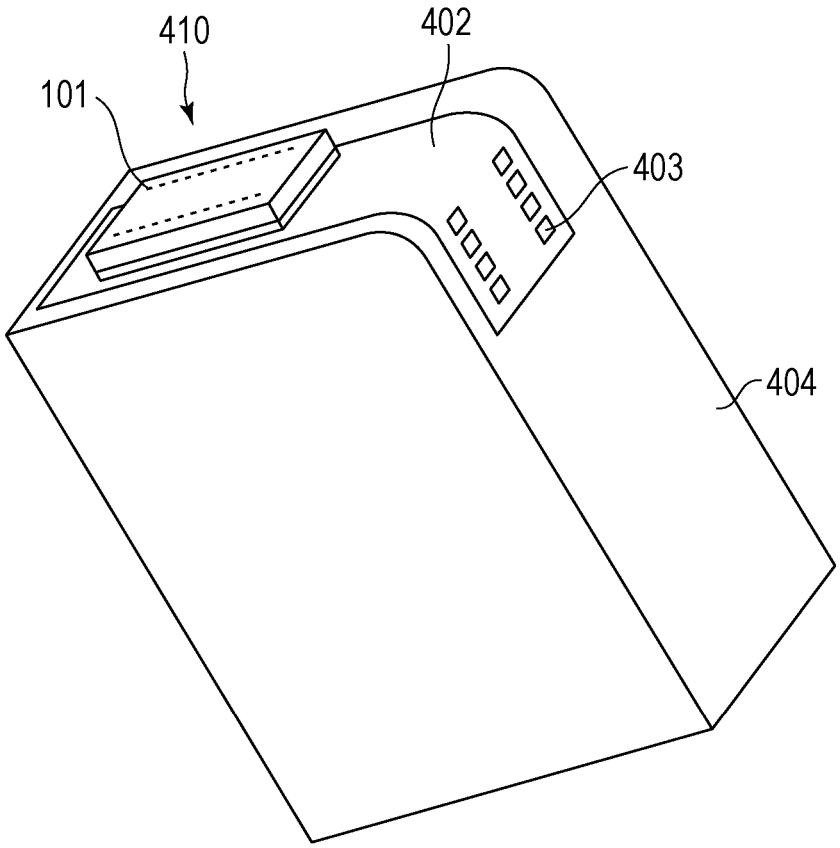
FIG. 2 is a perspective view of a reservoir provided with a liquid ejection head.

FIG. 2 is a perspective view of a reservoir provided with the liquid ejection head 410. The liquid ejection head 410 is configured by a substrate 101, an electrical wiring tape (i.e., a flexible wiring substrate) 402, and an electric contact portion 403 that is electrically connected with a recording apparatus main body. The liquid ejection head 410 is formed in a tank portion 404. The liquid supplied from the tank portion 404 is supplied to each ejection port of the liquid ejection head 410 and is ejected. In this manner, an image is formed on the recording medium.

Figure 3:
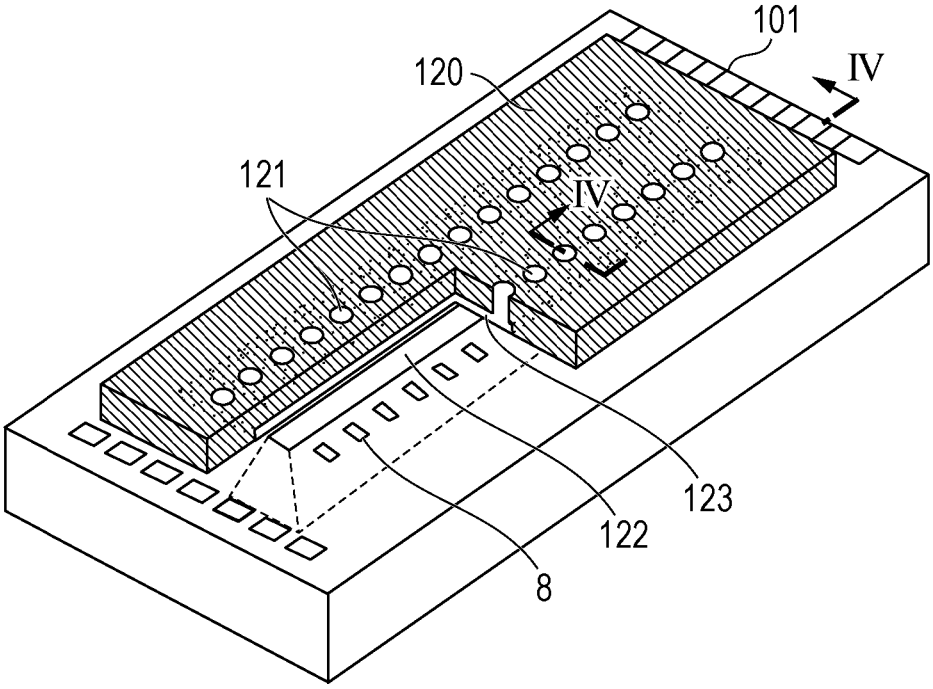
FIG. 3 is a perspective view of a substrate of a liquid ejection head.

FIG. 3 is a perspective view of the substrate of the liquid ejection head 410. In the substrate 101, for example, heat generating resistive elements 8 that cause a liquid to foam and a driving circuit that drives the heat generating resistive elements 8 are formed on a silicon substrate using semiconductor manufacturing technology. Further, a liquid supply port 122 for communicating both sides of the substrate 101 is formed. On the heat generating resistive elements 8, a flow path forming member 120 that forms a liquid flow path 123 is formed. The flow path forming member 120 is made of, for example, resin or inorganic film. In FIG. 3, ejection ports 121 are formed in the flow path forming member 120. The heat generating resistive element 8 corresponding to the ejection port 121 is made to generate heat, and the liquid is made to foam. The foaming causes pressure, with which the liquid is ejected to form an image on the recording medium.

Figure 4:
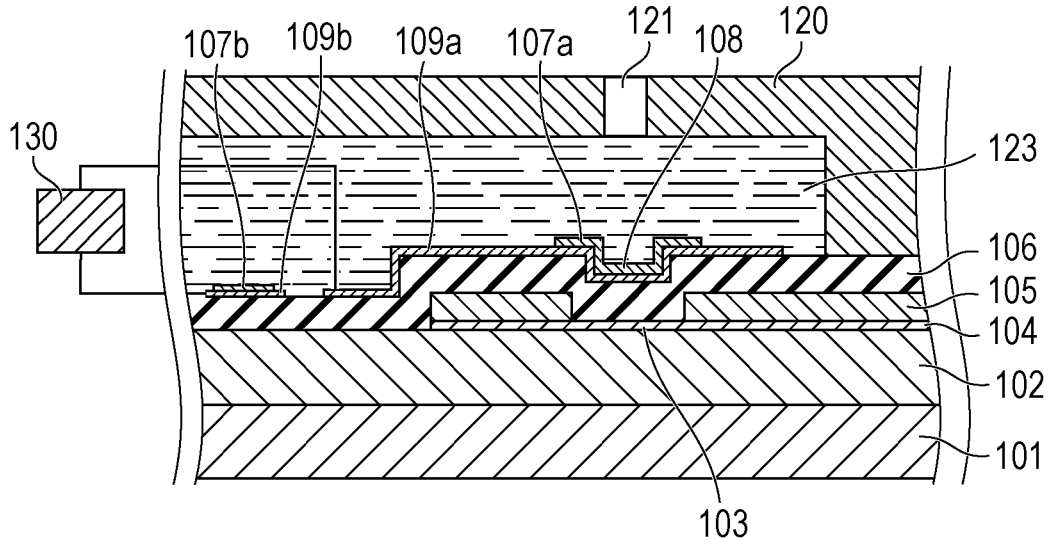
FIG. 4 is a cross-sectional view of the substrate of the liquid ejection head.

FIG. 4 is a cross-sectional view of the substrate 101 of the liquid ejection head 410 along line IV-IV of FIG. 3. The substrate 101 on which a driving elements, such as a transistor, is provided is made of, for example, silicon. On the substrate 101, a heat accumulation layer 102 made of a silicon compound is formed. On the heat accumulation layer 102, a heat generating resistive element 104 made of a material that generates heat when energized (e.g., TaSiN, WSiN, TaAlN, TiAl, or TiAlN) is formed. A pair of electrodes 105 made mainly of a material having lower resistance than that of the heat generating resistive element 104, e.g., Al, are provided in contact with the heat generating resistive element 104. A voltage is applied between the pair of electrodes 105 to cause a portion of the heat generating resistive element 104 located between the pair of electrodes 105 to generate heat. Between the pair of electrodes 105, a portion 103 at which the heat generating resistive element 104 is exposed exists, and at which the heat generating resistive element 104 especially generates heat. The heat generating resistive element 104 and the pair of electrodes 105 are covered with an insulating layer 106 made of an insulating material, such as a silicon compound, like SiN, to insulate the heat generating resistive element 104 and the pair of electrodes 105 from the liquid to be ejected.

The heat generating resistive element 104 is covered with a coating layer 107*a* to protect the heat generating resistive element 104 from chemical and physical impact caused by generation of heat by the heat generating resistive element 104. If the insulating layer 106 is formed, the coating layer 107*a* is formed to cover the insulating layer 106. The coating layer 107*a* is to be eluted when kogation is removed during a cleaning process, and becomes a kogation removal electrode during removal of kogation. The coating layer 107*a* is made of metal that is eluted by an electrochemical reaction in the liquid. The metal is, for example, Ir and Ru. A part of the coating layer 107*a* becomes a thermal action portion 108 that acts heat generated by the heat generating resistive element 104 on the liquid. Between the coating layer 107*a* and the insulating layer 106, a kogation removal electrode wiring 109*a* is provided. The kogation removal electrode wiring 109*a* constitutes a wiring portion that electrically connects the coating layer 107*a* to an external terminal, and is made of a material having electrical conductivity. The coating layer 107*a* is electrically connected to the external terminal via the kogation removal electrode wiring 109*a*.

In the liquid flow path, a counter electrode 107*b* is formed as an electrode opposite to the coating layer 107*a*. The counter electrode 107*b* may be made of, for example, Ir or Ru. The counter electrode 107*b* is connected to a counter electrode wire 109*b* made of, for example, Ta, and is connected to an external power supply 130.

A flow path forming member 120 that forms the liquid flow path 123 is formed on the substrate 101 of the liquid ejection head 410. The ejection ports 121 are formed at positions of the flow path forming member 120 corresponding to the thermal action portions 108, for example, above the thermal action portions 108. The ejection ports 121 communicate with the liquid flow path 123.

Next, a method for cleaning the liquid ejection head 410 of the present invention is described with reference to FIGS. 5A to 5C.

Figure 5A:
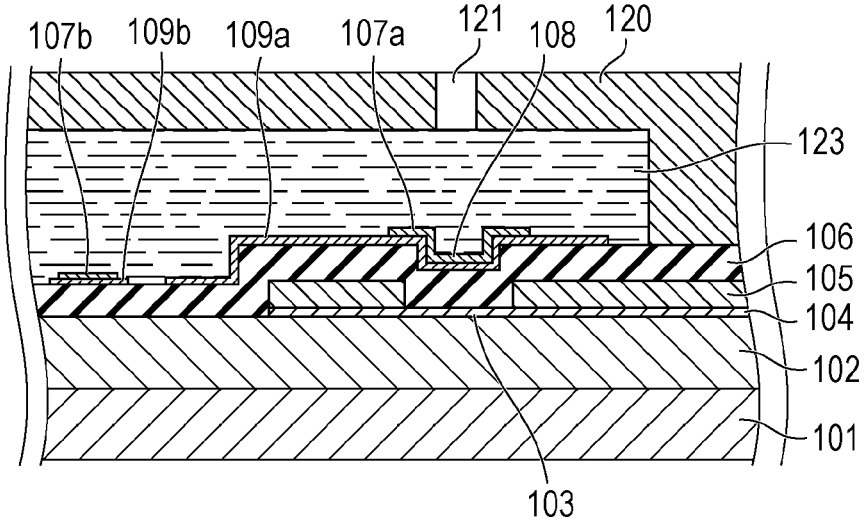
FIGS. 5A to 5C are cross-sectional views of the substrate during cleaning of the liquid ejection head.

As illustrated in FIG. 5A, a voltage is applied to the coating layer 107*a* with the liquid flow path filled with the liquid. In particular, for example, a positive voltage is applied to the coating layer 107*a* and a negative voltage is applied to the counter electrode 107*b*. Then, an electrochemical reaction occurs between the coating layer 107*a* and the liquid, and the coating layer 107*a* is eluted into the liquid. With this process, kogation deposited on the coating layer 107*a* may be removed (kogation removal).

By this electrochemical reaction, the liquid is electrolyzed on the coating layer 107*a*. Then, as illustrated in FIG. 5B, air bubbles are generated on a surface of the coating layer 107*a*. When the air bubbles are generated, the electrochemical reaction with the liquid becomes difficult to proceed, and then the coating layer 107*a* is not eluted sufficiently. That is, removal of kogation becomes difficult to proceed.

In the present invention, removal of kogation is promoted by eliminating the air bubbles. For this purpose, the heat generating resistive element 104 is made to generate heat while the voltage is applied to the coating layer 107*a*. For example, the liquid is made to foam by the generated heat. If kogation is removed while the voltage is applied to the coating layer 107*a*, the heat generating resistive element 104 is made to generate heat while kogation is removed. FIG. 5C illustrates a state in which the liquid has been made to foam. When the liquid is made to foam, the air bubbles generated by foaming take in air bubbles that originally exist on the coating layer 107*a*. Alternatively, the air bubbles generated by foaming push out air bubbles that originally exist on the coating layer 107*a*. Thus, the air bubbles are eliminated from the surface of the coating layer 107*a*. Elimination of the air bubbles promotes removal of kogation. The liquid is made to foam by causing the heat generating resistive element 104 to generate heat while the voltage is applied to the coating layer 107*a*. The air bubbles may be removed favorably by causing the liquid to foam at this timing. It is desirable that kogation has been removed when the liquid foams. That is, it is desirable that the liquid foams during the removal of kogation.

Considering foaming of the liquid, it is desirable that the heat generating resistive element 104 is made to generate heat before the entire coating layer 107*a* that covers the heat generating resistive element 104 is covered with air bubbles. If the entire coating layer 107*a* is covered with air bubbles, the coating layer 107*a* is no more contact with the liquid. Then, it is difficult to cause the liquid to foam any more. If the coating layer 107*a* is in contact with the liquid at least partly, the liquid is easily made to foam starting at the contacting point. In this regard, it is desirable to cause the heat generating resistive element 104 to generate heat within two seconds after application of the voltage to the coating layer 107*a* is started, and it is more desirable to cause the heat generating resistive element 104 to generate heat within one second after application of the voltage to the coating layer 107*a* is started.

The liquid does not necessarily have to foam. In a case in which the liquid does not foam, it is only necessary to cause the liquid to be ejected from the ejection ports by causing the heat generating resistive element 104 to generate heat. By causing the liquid to be ejected, the air bubbles, covering the coating layer 107*a*, generated due to the electrochemical reaction may be eliminated with the ejection.

On the other hand, the liquid does not necessarily have to be ejected from the ejection ports 121 during the foaming for the elimination of the air bubbles. Also in a configuration in which the liquid is not ejected from the ejection ports 121, the electrochemical reaction proceeds when the air bubbles generated by the electrochemical reaction due to the foaming move from the coating layer 107*a*. However, the air bubbles may stay in the liquid flow path 123 in this case. Therefore, it is desirable to eject the liquid from the ejection ports 121 at the time of foaming of the liquid for the elimination of the air bubbles. If the liquid is ejected from the ejection ports 121 by foaming, the air bubbles are also easily discharged from the ejection ports 121. Therefore, staying of the air bubbles in the liquid flow path 123 may be prevented effectively.

An image may be formed on the recording medium by ejecting the liquid from the ejection ports 121. However, considering the possibility that kogation exists in the liquid, it is desirable that this ejection is used in auxiliary ejection (i.e., auxiliary ejection in which liquid is ejected not at the recording medium, such as paper, and not for recording).

It is desirable that generation of heat of the heat generating resistive element 104 (foaming of the liquid in a case in which the liquid is made to foam) is performed before the voltage is applied to the coating layer 107*a*. It is more desirable to perform generation of heat of the heat generating resistive element 104 before the removal of kogation. Further, it is desirable to perform generation of heat of the heat generating resistive element 104 continuously from before time at which the voltage is applied to the coating layer 107*a* to time at which the voltage is applied to the coating layer 107*a*. Especially if the liquid is ejected from the ejection ports 121, the liquid may be used also for the formation of the image. Therefore, it is desirable to form an image on the recording medium by ejecting the liquid continuously from the ejection ports in terms of efficiency. With this configuration, kogation may be removed favorably while the image is formed. However, considering the possibility that kogation exists in the liquid as described above, it is desirable that auxiliary ejection is performed in the ejection for the removal of kogation, and then ejection for recording on the recording medium is performed.

Figure 5B:
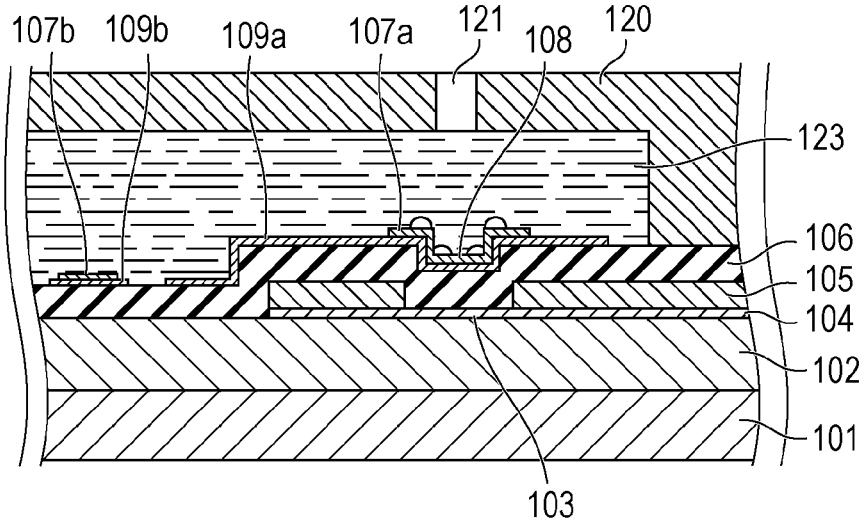
Figure 5C:
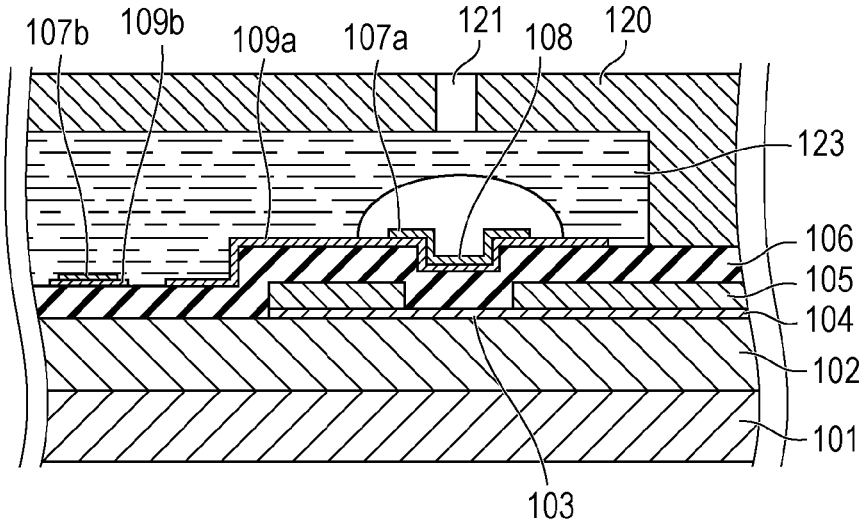

By causing the liquid to foam, as illustrated in FIG. 5C, it is possible to restore the state illustrated in FIG. 5A from the state illustrated in FIG. 5B. That is, since the air bubbles are eliminated, kogation may be removed favorably. Since suction and pressurizing of the liquid are not necessary for the removal of kogation, kogation may be removed by a simple method. Further, a liquid ejecting apparatus capable of removing kogation by such a simple method may be provided.

EXAMPLES

Example 1

A liquid ejection head is cleaned using a substrate of a liquid ejection head illustrated in FIG. 4. The substrate 101 is made of Si and the heat accumulation layer 102 is made of $SiO_2$. The heat generating resistive element 104 is made of TaSiN, and is 50 nm in thickness. The electrode 105 is made of Al and is 300 nm in thickness. The insulating layer 106 is made of SiN and is 350 nm in thickness. The kogation removal electrode wiring 109*a* and the counter electrode wire 109*b* are made of Ta, and are 100 nm in thickness. The coating layer 107*a* and the counter electrode 107*b* are made of Ir, and are 100 nm in thickness. The coating layer 107*a* is connected to the external power supply 130 via the kogation removal electrode wiring 109*a*. The counter electrode 107*b* is connected to the external power supply 130 via the counter electrode wire 109*b*.

In a liquid ejecting apparatus (i.e., an inkjet printer) provided with such a liquid ejection head 410, the heat generating resistive element 104 is driven to eject cyan ink (trade name; BCI-7eC, manufactured by CANON KABUSHIKI KAISHA), which is used as a liquid. As ejection conditions of the liquid, $1.0\times10^9$ driving pulses at a voltage of 24 V, a pulse width of 0.82 μs, and a frequency of 15 kHz are applied to the heat generating resistive element 104.

Then, a surface state of the heat generating resistive element 104 is observed under an electron microscope, and kogation is found to be deposited on the coating layer 107*a* corresponding to the thermal action portion 108.

The liquid is ejected from the liquid ejection head 410 with kogation deposited thereon, and then an image on the recording medium is examined under the microscope. As a result, a disorder of the image considered to be caused by ejection dot misalignment of the liquid is found. Ejection speeds of the liquid before and after the deposition of kogation are measured using an ink droplet speed measuring apparatus. The ejection speed before the deposition of kogation is 15 m/s, while the ejection speed after the deposition of kogation is 9 m/s. That is, the ejection speed has decreased by 6 m/s.

Next, the liquid ejection head 410 is cleaned. A DC voltage of 5 V is applied to the external power supply 130 connected to the coating layer 107*a* so that the coating layer 107*a* is used as an anode electrode, and the counter electrode 107*b* is used as a cathode electrode.

Figure 6A:
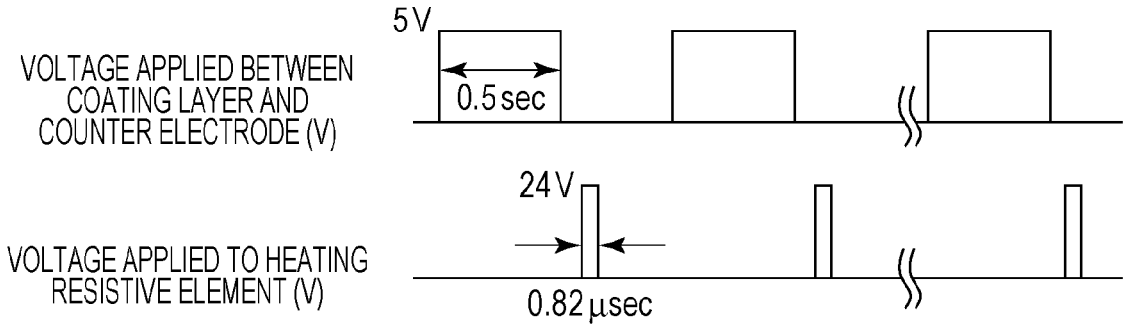
FIGS. 6A to 6C are diagrams illustrating a voltage application method during cleaning of the liquid ejection head.

The cleaning is performed in the following procedure as illustrated in FIG. 6A. First, a DC voltage of 5 V is applied between the coating layer 107*a* and the counter electrode 107*b*. Under this cleaning condition, when the voltage is applied for about 1 s, the entire coating layer 107*a* is covered with air bubbles. Therefore, it is found that the electrochemical reaction does not proceed any more substantially. For this reason, voltage application time between electrodes is set to 0.5 s.

Then, driving pulses at a voltage of 24 V and a pulse width of 0.5 μs are applied to the electrothermal converting element to cause the liquid to foam. Application of the DC voltage between the coating layer 107*a* and the counter electrode 107*b* and ejection of the liquid are made as one cleaning cycle, and 60 cleaning cycles are repeated. That is, the heat generating resistive element 104 is made to generate heat while applying the voltage to the coating layer, and the liquid is made to foam.

When the surface of the coating layer 107*a* is observed under the electron microscope, it is found that the deposited kogation has been removed.

The ejection speed of the liquid at this time is measured using an ink droplet speed measuring apparatus, and found to be 15 m/s. The ejection speed has recovered to the ejection speed before the deposition of kogation. The image on the recording medium is examined under the microscope. Dots are found to have landed at desired positions and favorable printing quality is found to have been obtained.

It is desirable that the liquid is made to foam by causing the heat generating resistive element 104 to generate heat during removal of the kogation before the entire coating layer 107*a* is covered with air bubbles. Time until the coating layer 107*a* is covered with air bubbles varies depending on the type of the liquid used in the cleaning and the cleaning conditions. For example, if a voltage of 15 V is applied between the coating layer 107*a* and the counter electrode 107*b*, the electrochemical reaction proceeds at a higher speed than under the condition described above (i.e., a voltage of 5 V is applied). Therefore, the coating layer 107*a* is covered with air bubbles in equal to or less than 0.5 s from the start of voltage application to each electrode. Also in this case, kogation may be removed favorably by, for example, temporarily stopping application of the voltage between the electrodes before the entire coating layer 107*a* is covered with air bubbles, and causing the liquid to foam.

Example 2

Figure 6B:
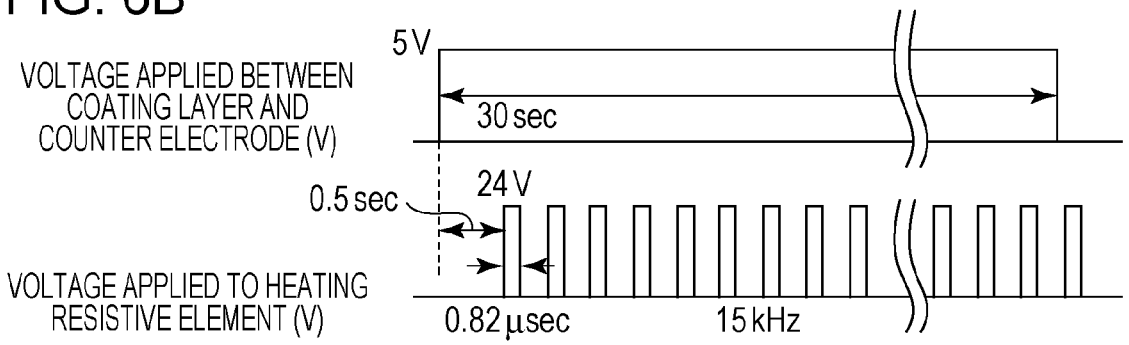

In Example 2, the same liquid ejection head as that of Example 1 is used. In Example 2, as illustrated in FIG. 6B, a DC voltage of 5 V is applied for 30 s between the coating layer 107*a* and the counter electrode 107*b*. When 0.5 s elapsed after the application of the DC voltage is started, driving pulses at a voltage of 24 V, a pulse width of 0.82 μs, and a frequency of 15 kHz are applied to the heat generating resistive element 104, and the liquid is continuously ejected for several seconds until the end of application of the DC voltage.

In Example 2, the liquid is ejected at the same frequency as that of normal ejection of the liquid. The liquid is ejected from the ejection ports 121. The liquid is ejected also after the kogation is removed.

Therefore, as in Example 1, it is found that kogation deposited till then has been removed from the coating layer 107*a*.

The ejection speed of the liquid at this time is measured using an ink droplet speed measuring apparatus, and found to be 15 m/s. The ejection speed has recovered to the ejection speed before the deposition of kogation. The image on the recording medium is examined under the microscope. Dots are found to have landed at desired positions and favorable printing quality is found to have been obtained.

In Example 2, the liquid is ejected from the ejection ports 121 during the foaming for the removal of air bubbles. In this manner, air bubbles are favorably eliminated from the flow path. An image is recorded with the liquid ejected at this time. That is, the liquid is continuously made to foam, and the liquid is continuously ejected from the ejection ports 121, whereby kogation is removed continuously. Therefore, kogation may be removed more efficiently than when removed intermittently.

Example 3

Figure 6C:
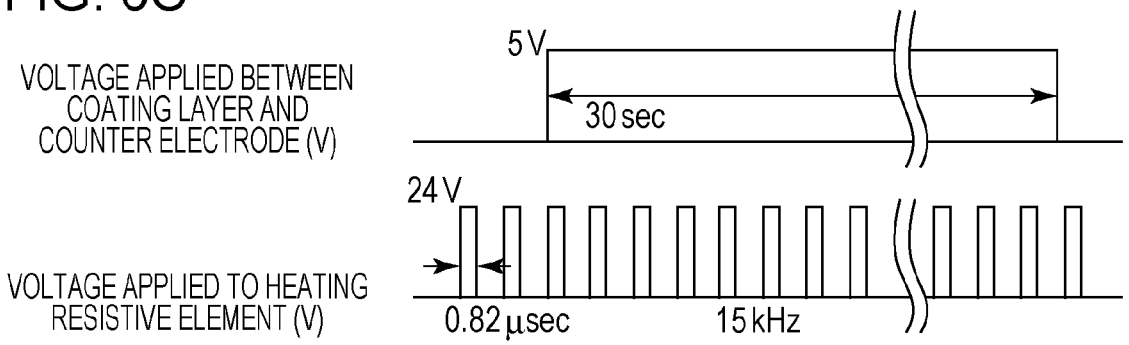

Also in Example 3, the same liquid ejection head as that of Example 1 is used. In Example 3, as illustrated in FIG. 6C, driving pulses at a voltage of 24 V, a pulse width of 0.82 μs, and a frequency of 15 kHz are applied in advance to the heat generating resistive element 104, continuous ejection of the liquid is started, and then, a DC voltage of 5 V is applied for 30 s between the coating layer 107*a* and the counter electrode 107*b*.

Although kogation may be removed simultaneously with the start of ejection of the liquid in the present invention, since timing at which the liquid is ejected and timing at which kogation is removed need to be controlled, it is desirable to start ejection of the liquid and then apply a voltage between the electrodes to remove kogation.

Therefore, as in Example 1, it is found that kogation deposited till then has been removed from the coating layer 107*a*.

The ejection speed of the liquid at this time is measured using an ink droplet speed measuring apparatus, and found to be 15 m/s. The ejection speed has recovered to the ejection speed before the deposition of kogation. The image on the recording medium is examined under the microscope. Dots are found to have landed at desired positions and favorable printing quality is found to have been obtained.

Also in Example 3, like Example 2, air bubbles in the flow path may be eliminated favorably. In Example 3, the liquid is ejected before the voltage is applied between the coating layer 107*a* and the counter electrode 107*b*. In this case, the cleaning process is performed using BCI-7eC (manufactured by CANON KABUSHIKI KAISHA). If other liquids are used, there is a possibility that the electrochemical reaction speed varies and the time until the coating layer 107*a* is covered with air bubbles is shortened. From this viewpoint, as in Example 3, it is desirable to cause the liquid to foam for the elimination of air bubbles, before the voltage is applied between the coating layer 107*a* and the counter electrode 107*b*, i.e., before kogation is removed.

While the present invention has been described with reference to exemplary embodiments, it is to be understood that the invention is not limited to the disclosed exemplary embodiments.

The scope of the following claims is to be accorded the broadest interpretation so as to encompass all such modifications and equivalent structures and functions. This application claims the benefit of Japanese Patent Application No. 2014-089515, filed Apr. 23, 2014 which is hereby incorporated by reference in its entirety.

What is claimed is:

1. A method for cleaning a liquid ejection head, which includes a flow path forming member configured to form a liquid flow path, a heat generating resistive element, and a coating layer configured to cover the heat generating resistive element and configured to be in contact with the liquid, in which the heat generating resistive element is made to generate heat and the liquid is made to be ejected from an ejection port, the method comprising:

applying a voltage to the coating layer to produce an electrochemical reaction between the coating layer and the liquid, and causing the coating layer to be eluted into the liquid, thereby removing kogation deposited on the coating layer; and ejecting the liquid from the ejection port by causing the heat generating resistive element to generate heat while a voltage is applied to the coating layer continuously to produce the electrochemical reaction.

2. The method for cleaning a liquid ejection head according to claim 1, wherein the liquid is made to foam by causing the heat generating resistive element to generate heat to eject the liquid from the ejection port while the voltage is applied to the coating layer.

3. The method for cleaning a liquid ejection head according to claim 1, wherein an image is formed on a recording medium by ejecting the liquid from the ejection port while the voltage is applied to the coating layer.

4. The method for cleaning a liquid ejection head according to claim 1, wherein auxiliary ejection with which no image is formed on a recording medium is performed by ejecting the liquid from the ejection port while the voltage is applied to the coating layer.

5. The method for cleaning a liquid ejection head according to claim 1, wherein generation of heat of the heat generating resistive element is performed continuously from before time at which the voltage is applied to the coating layer to time at which the voltage is applied to the coating layer.

6. The method for cleaning a liquid ejection head according to claim 1, wherein the heat generating resistive element is made to generate heat with the coating layer that covers the heat generating resistive element being in contact with the liquid while the voltage is applied to the coating layer.

7. The method for cleaning a liquid ejection head according to claim 1, wherein the heat generating resistive element is made to generate heat within two seconds after application of the voltage to the coating layer is started.

8. The method for cleaning a liquid ejection head according to claim 1, wherein the heat generating resistive element is made to generate heat within one second after application of the voltage to the coating layer is started.

9. The method for cleaning a liquid ejection head according to claim 1, wherein the liquid is made to be ejected by causing the heat generating resistive element to generate heat while the voltage is applied to the coating layer to eliminate air bubbles generated due to the electrochemical reaction.

10. The method for cleaning a liquid ejection head according to claim 1, wherein the heat generating resistive element is made to generate heat a plurality of times while the voltage is applied to the coating layer.

11. A liquid ejecting apparatus comprising a liquid ejection head, comprising a flow path forming member configured to form a liquid flow path, a heat generating resistive element, and a coating layer configured to cover the heat generating resistive element and configured to be in contact with the liquid, the liquid ejection head causing the heat generating resistive element to generate heat and causing the liquid to be ejected from an ejection port, the liquid ejecting apparatus applying a voltage to the coating layer continuously to produce an electrochemical reaction between the coating layer and the liquid and causing the coating layer to be eluted into the liquid, thereby enabling removal of kogation deposited on the coating layer, wherein the liquid is made to be ejected from the ejection port by causing the heat generating resistive element to generate heat while the voltage is applied to the coating layer continuously to produce the electrochemical reaction.

12. The liquid ejecting apparatus according to claim 11, wherein the liquid is made to foam by causing the heat generating resistive element to generate heat to eject the liquid from the ejection port while the voltage is applied to the coating layer.

13. The liquid ejecting apparatus according to claim 11, wherein generation of heat of the heat generating resistive element is performed continuously from before time at which the voltage is applied to the coating layer to time at which the voltage is applied to the coating layer.

14. The liquid ejecting apparatus according to claim 11, wherein the heat generating resistive element is made to generate heat within two seconds after application of the voltage to the coating layer is started.

* * * * *